US009261819B1

(12) United States Patent
Makie

(10) Patent No.: US 9,261,819 B1
(45) Date of Patent: Feb. 16, 2016

(54) DEVELOPER SUPPLY DEVICE AND IMAGE FORMING APPARATUS PROVIDED WITH SAME

(71) Applicant: KYOCERA Document Solutions Inc., Osaka-shi, Osaka (JP)

(72) Inventor: Ikuo Makie, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/805,856

(22) Filed: Jul. 22, 2015

(30) Foreign Application Priority Data

Jul. 25, 2014 (JP) ..... 2014-151932

(51) Int. Cl.
*G03G 15/08* (2006.01)

(52) U.S. Cl.
CPC ..... *G03G 15/0886* (2013.01)

(58) Field of Classification Search
CPC ..... G03G 15/0886
USPC ..... 399/27, 260, 258
See application file for complete search history.

(56) References Cited

U.S. PATENT DOCUMENTS 8,918,032 B2 * 12/2014 Abler ..... G03G 15/0877 399/262

FOREIGN PATENT DOCUMENTS

| | | |
|---|---|---|
| EP | 1 076 271 | 2/2001 |
| JP | 2001-92230 | 4/2001 |
| JP | 2004-151340 | 5/2004 |

* cited by examiner

*Primary Examiner* — Susan Lee
(74) *Attorney, Agent, or Firm* — Gerald E. Hespos; Michael J. Porco; Matthew T. Hespos

(57) ABSTRACT

A developer supply device includes a shaft portion arranged in a container main body, a moving wall movable along the shaft portion, a developer discharge port and a shutter mechanism. A control unit causes the moving wall to be arranged at a first position when a remaining amount of the developer is a predetermined first remaining amount and moves the moving wall to a second position closer to the developer discharge port than the first position in the first direction when the remaining amount is a second remaining amount smaller than the first remaining amount, and causes the shutter mechanism to be set in a first open state with a predetermined opening degree when the moving wall is at the first position and causes the shutter mechanism to be set in a second open state larger than the first open state when the moving wall is at the second position.

7 Claims, 15 Drawing Sheets

DEVELOPER SUPPLY DEVICE AND IMAGE FORMING APPARATUS PROVIDED WITH SAME

INCORPORATION BY REFERENCE

This application is based on Japanese Patent Application No. 2014-151932 filed with the Japan Patent Office on Jul. 25, 2014, the contents of which are hereby incorporated by reference.

BACKGROUND

The present disclosure relates to a developer supply device for supplying developer and an image forming apparatus to which the developer supply device is applied.

In an electrophotographic image forming apparatus, a volumetric supply method for supplying toner from a toner container without depending on a toner sensor if the amount of the toner in a developing device decreases is known as a method for supplying toner to a developing device for developing an electrostatic latent image on a photoconductive drum with the toner. In this method, an area where a toner conveying capacity is reduced is formed at a slightly downstream side of a toner supply port in a circulating conveyance path for toner in the developing device and the toner supply port is constantly closed with the toner.

A known toner container is configured such that a moving wall is arranged in the container and moves toward a toner discharge port according to a remaining amount of toner.

SUMMARY

A developer supply device according to one aspect of the present disclosure includes a container main body, a shaft portion, a moving wall, a developer discharge port, a shutter mechanism and a control unit.

The container main body is provided with a wall defining an inner space for containing developer. The shaft portion is arranged to extend in a first direction in the inner space. The moving wall conveys the developer by moving from an upstream side to a downstream side in the first direction along the shaft portion in the inner space. The developer discharge port is arranged near a downstream end of the container main body in the first direction and penetrates through the wall to allow communication between the inner space and outside. The shutter mechanism switches an open state of the developer discharge port among a closed state, a first open state where the developer discharge port is open to a predetermined degree and a second open state where the developer discharge port is open to a larger opening degree than in the first open state. The control unit controls a movement of the moving wall and a switch of the open state of the shutter mechanism.

The control unit causes the moving wall to be arranged at a first position in the first direction when a remaining amount of the developer in the container main body is a predetermined first remaining amount and moves the moving wall to a second position closer to the developer discharge port than the first position in the first direction when the remaining amount is a second remaining amount smaller than the first remaining amount, and causes the shutter mechanism to be set in the first open state when the moving wall is at the first position and causes the shutter mechanism to be set in the second open state when the moving wall is at the second position.

An image forming apparatus according to another aspect of the present disclosure includes the above developer supply device, an image carrier configured to carry an electrostatic latent image and a developer image, a developing device configured such that the developer is supplied thereto from the developer supply device and supplied to the image carrier therefrom, and a transfer unit configured to transfer the developer image from the image carrier to a sheet.

DETAILED DESCRIPTION

Figure 1:
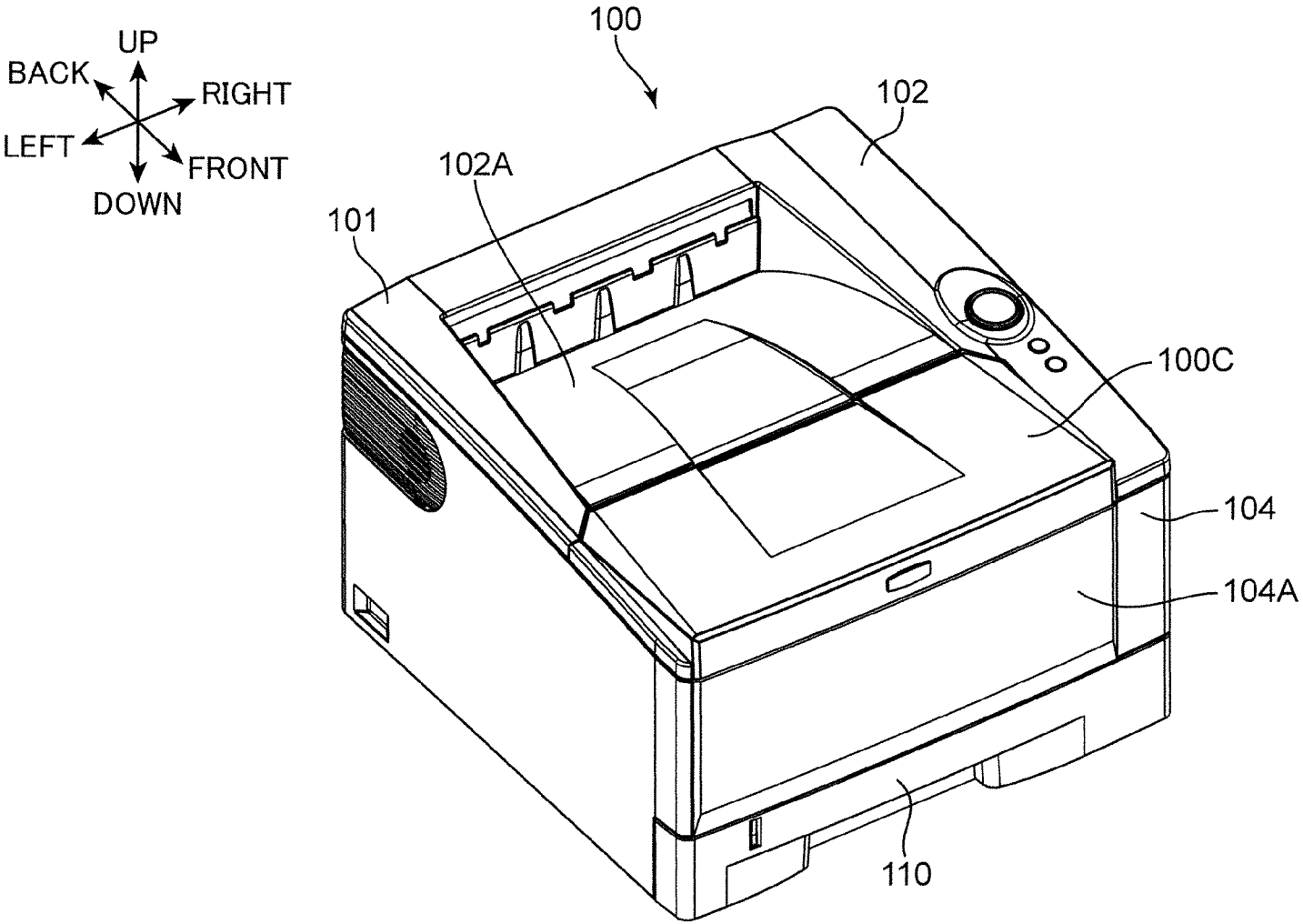
FIG. 1 is a perspective view showing an image forming apparatus according to one embodiment of the present disclosure.
Figure 2:
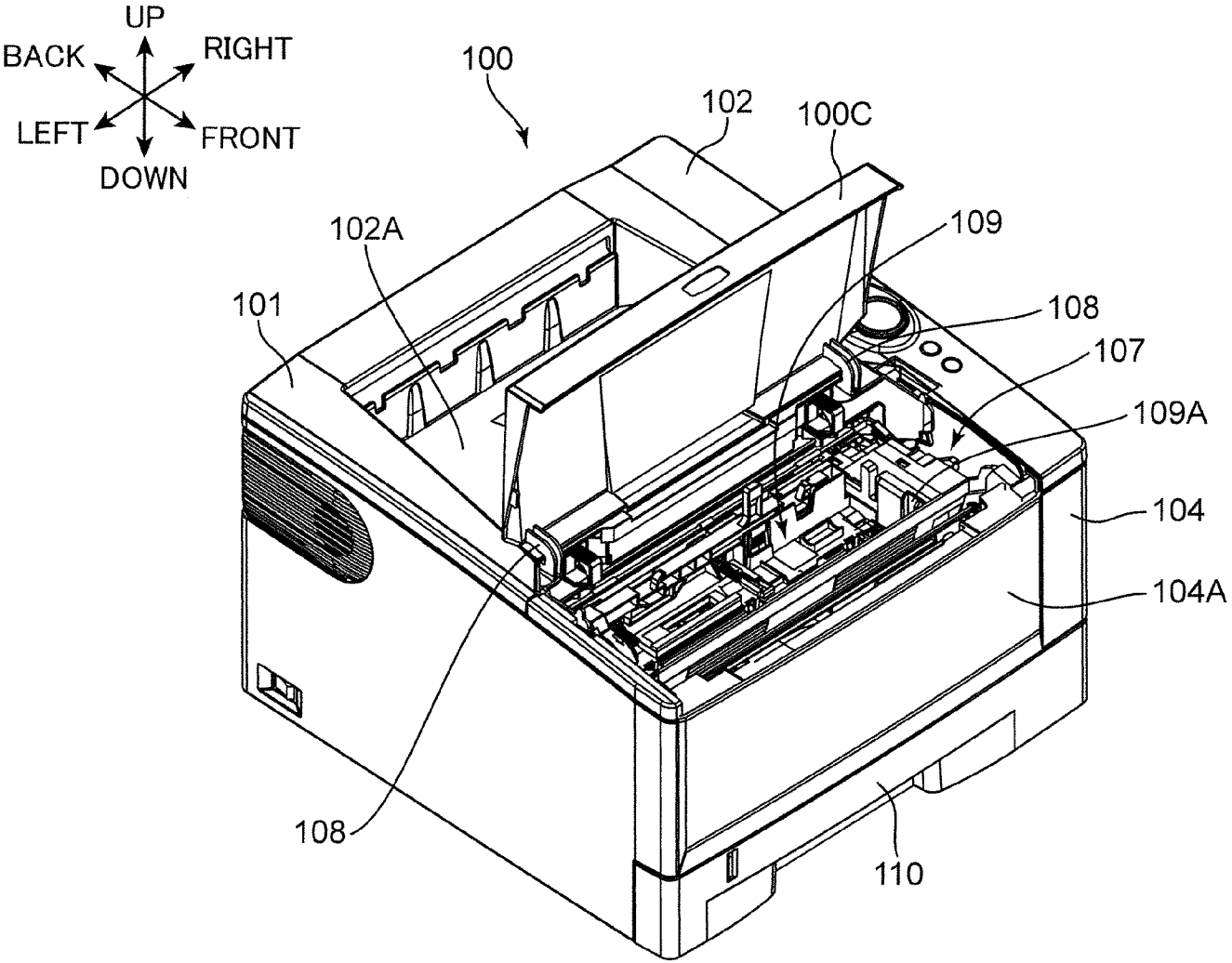
FIG. 2 is a perspective view showing a state where a housing of the image forming apparatus is partly open.
Figure 3:
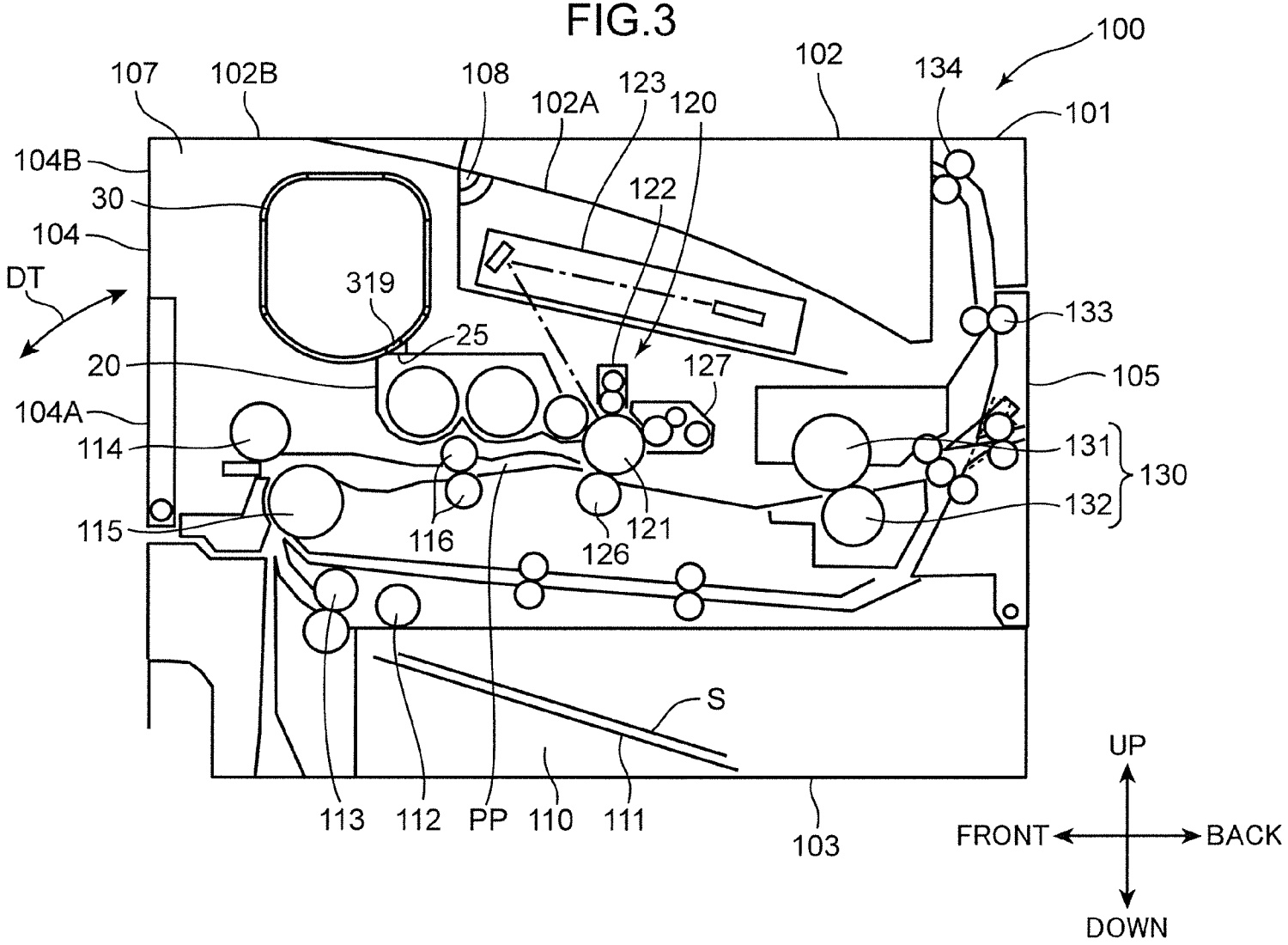
FIG. 3 is a schematic sectional view showing the internal structure of the image forming apparatus.

Hereinafter, an embodiment of the present disclosure is described with reference to the drawings. FIG. 1 is a perspective view showing a printer 100 (image forming apparatus) according to one embodiment of the present disclosure, FIG. 2 is a perspective view showing a state where a housing 101 of the printer 100 is partly open and FIG. 3 is a schematic sectional view showing the internal structure of the printer 100. Although the printer 100 is a so-called monochromatic printing machine, the image forming apparatus may be a color printer, a facsimile machine or a multifunction machine provided with these functions in another embodiment.

The printer 100 includes the housing 101 for housing various devices for forming an image on a sheet S. The housing 101 has an upper wall 102 defining the upper surface of the housing 101, a bottom wall 103 (FIG. 3) defining the bottom surface of the housing 101, a rear wall 105 (FIG. 3) between the upper wall 102 and the bottom wall 103 and a front wall 104 located before the rear wall 105. The housing 101 includes an inner space 107 in which various devices are arranged. A sheet conveyance path PP in which a sheet S is conveyed in a predetermined conveying direction is provided in the internal space 107 of the housing 101. A part of the housing 101 is openable by an opening/closing cover 100C as shown in FIG. 2. When the opening/closing cover 100C is opened upward by being rotated about a hinge shaft 108, an upper part of the internal space 107 is open to outside. A part exposed by this opening is a container housing portion 109 for housing a toner container 30 to be described later.

A sheet discharge unit 102A is arranged in a central part of the upper wall 102. A sheet S having an image formed thereon in an image forming unit 120 to be described later is discharged to the sheet discharge unit 102A. A manual feed tray 104A is arranged in a vertical central part of the front wall 104. The manual feed tray 104A is vertically rotatable with the lower end thereof as a supporting point (arrow DT of FIG. 3).

With reference to FIG. 3, the printer 100 includes a cassette 110, a pickup roller 112, a first feed roller 113, a second feed roller 114, a conveyor roller 115, a pair of registration rollers 116, the image forming unit 120 and a fixing device 130.

The cassette 110 stores sheets S inside. The cassette 110 includes a lift plate 111 inclined to push up the leading edges of the sheets S. The cassette 110 can be pulled out forward from the housing 101. The pick-up roller 112 is arranged above the leading edges of the sheets S pushed up by the lift plate 111. When the pick-up roller 112 rotates, a sheet is pulled out from the cassette 110. The first feed roller 113 is arranged downstream of the pick-up roller 112 to feed the sheet S further to a downstream side. The second feed roller 114 is arranged at the inner side (rear side) of the supporting point of the manual feed tray 104A and pulls a sheet S on the manual feed tray 104A into the housing 101.

The conveyor roller 115 is arranged downstream of the first and second feed rollers 113, 114 in a sheet conveying direction. The conveyor roller 115 conveys the sheet S fed by the first and second feed rollers 113, 114 further to the downstream side. The pair of registration rollers 116 function to correct the oblique feed of the sheet S. Further, the pair of registration rollers 116 feed the sheet S to the image forming unit 120 in accordance with an image formation timing by the image forming unit 120.

The image forming unit 120 includes a photoconductive drum 121 (image carrier), a charger 122, an exposure device 123, a developing device 20, the toner container 30 (part of a developer supply device), a transfer roller 126 (transfer unit) and a cleaning device 127.

The photoconductive drum 121 is a cylindrical member and carries an electrostatic latent image and a toner image (developer image) on a circumferential surface thereof. The charger 122 substantially uniformly charges the circumferential surface of the photoconductive drum 121. The exposure device 123 forms an electrostatic latent image on the circumferential surface of the photoconductive drum 121. The exposure device 123 includes a light source such as a laser diode, a deflector, a scanning lens, an optical element and the like and irradiates laser light corresponding to image data to the circumferential surface of the photoconductive drum 121 substantially uniformly charged by the charger 122.

The developing device 20 supplies toner to the circumferential surface of the photoconductive drum 121 having an electrostatic latent image formed thereon. The toner container 30 is a container for storing the toner and supplies the toner to the developing device 20. The developing device 20 supplies the toner to the photoconductive drum 121, whereby the electrostatic latent image formed on the circumferential surface of the photoconductive drum 121 is developed (visualized). As a result, a toner image (developer image) is formed on the circumferential surface of the photoconductive drum 121. Detailed structures of the developing device 20 and the toner container 30 are described in detail later.

The transfer roller 126 is arranged to face the photoconductive drum 121 from below and a transfer nip portion is formed between the transfer roller 126 and the photoconductive drum 121. A transfer bias is applied to the transfer roller 126 to transfer a toner image formed on the photoconductive drum 121 to a sheet S. The cleaning device 127 removes the toner remaining on the circumferential surface of the photoconductive drum 121 after the toner image is transferred to the sheet S.

The fixing device 130 includes a fixing roller 131 with a built-in heater and a pressure roller 132 arranged to face the fixing roller 131. The fixing device 130 fixes a toner image to a sheet by heating and pressing the sheet having the toner image transferred thereto. A pair of conveyor rollers 133 and a pair of discharge rollers 134 arranged downstream of the pair of conveyor rollers 133 are arranged downstream of the fixing device 130. A sheet S after a fixing process is conveyed upward by the pair of conveyor rollers 133 and finally discharged from the housing 101 by the pair of discharge rollers 134. The sheet S discharged from the housing 101 is stacked on the sheet discharge unit 102A.

Figure 4:
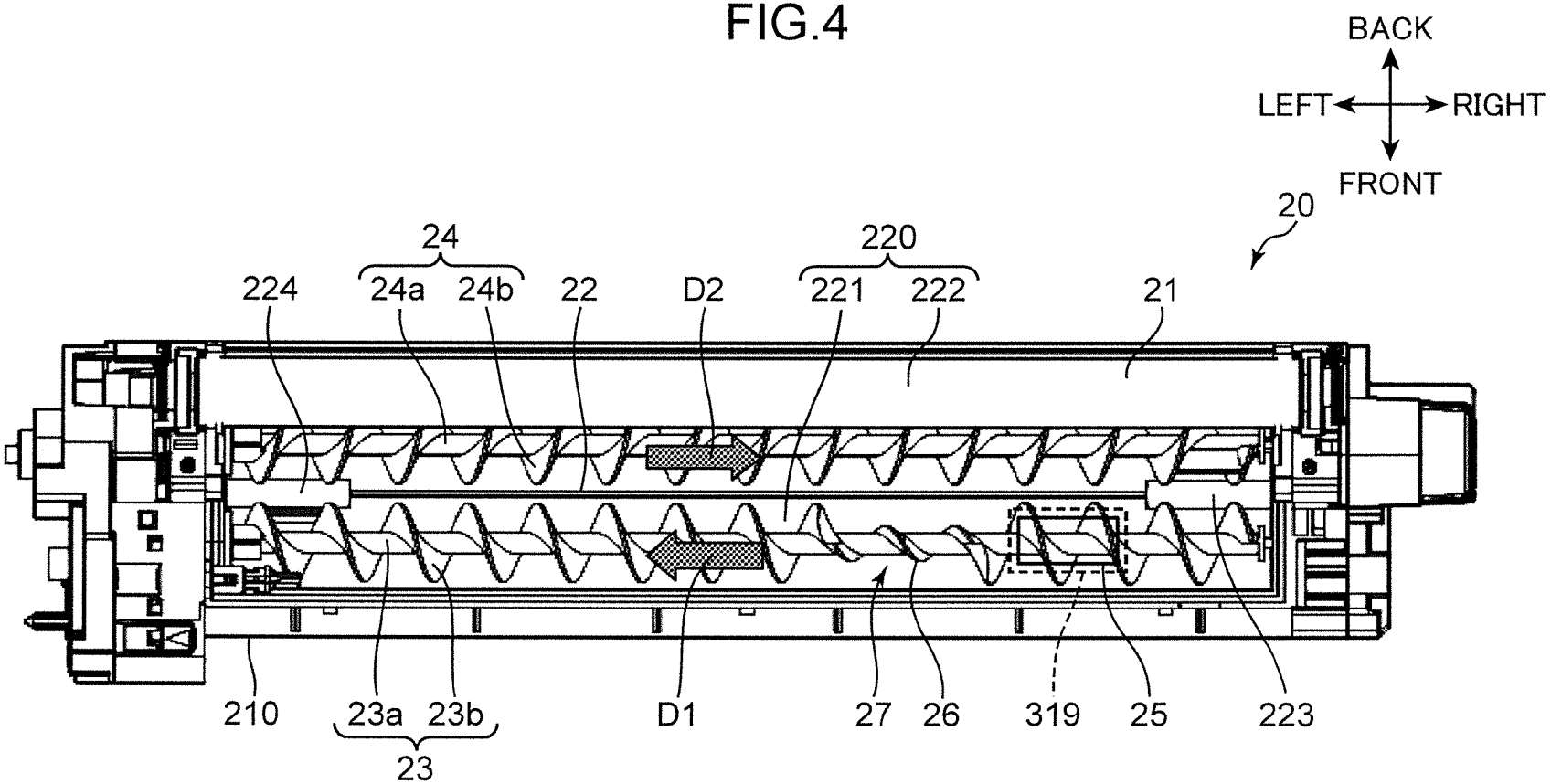
FIG. 4 is a plan view showing the internal structure of a developing device provided in the image forming apparatus.

Next, the developing device 20 is described in detail. FIG. 4 is a plan view showing the internal structure of the developing device 20. The developing device 20 includes a development housing 210 having a box shape long in one direction (lateral direction). The development housing 210 includes a storage space 220 and a toner supply port 25. A developing roller 21 and a first and a second agitation screws 23, 24 (developer conveying member) are arranged in the storage space 220. In this embodiment, a one-component development method is adopted and the toner is filled as developer in this storage space 220. In another embodiment in which a two-component development method is adopted, developer in which toner and carrier made of a magnetic material are mixed is filled in the storage space 220. The toner is agitated and conveyed in the storage space 220 and successively supplied to the photoconductive drum 121 from the developing roller 21 to develop an electrostatic latent image. The developing roller 21 has a cylindrical shape extending in a longitudinal direction of the development housing 210 and includes a sleeve part to be driven to rotate on the outer periphery.

The storage space 220 of the development housing 210 is covered by an unillustrated ceiling plate and divided into a first and a second conveyance paths 221, 222 long in the lateral direction by a partition plate 22 extending in the lateral direction. The partition plate 22 is shorter than a lateral width of the development housing 210 and a first and a second communication paths 223, 224 respectively allowing the first and second conveyance paths 221, 222 to communicate are provided on the right and left ends of the partition plate 22. In this way, a circulation path (developer conveyance path) composed of the first conveyance path 221, the second communication path 224, the second conveyance path 222 and the first communication path 223 is formed in the storage space 220. The toner is conveyed clockwise in the circulation path as indicated by arrows D1, D2 in FIG. 4.

The toner supply port 25 (developer support port) is an opening perforated on the ceiling plate and arranged above the vicinity of the right end of the first conveyance path 221. The toner supply port 25 is an opening arranged to face the above circulation path and configured to receive replenishment toner supplied from the toner container 30 in the storage space 220.

The first agitation screw 23 is arranged in the first conveyance path 221. The first agitation screw 23 includes a first rotary shaft 23*a* and a first spiral blade 23*b* spirally projecting on the outer periphery of the first rotary shaft 23*a*. The first agitation screw 23 conveys the toner in a direction of the arrow D1 of FIG. 4 by being driven to rotate about the first rotary shaft 23*a*. The first agitation screw 23 conveys the toner in such a manner as to pass a position where the toner supply port 25 faces the first conveyance path 221. In this way, the first agitation screw 23 conveys the toner while mixing new toner flowing in through the toner supply port 25 and the toner conveyed into the first conveyance path 221 from the side of the second conveyance path 222. The toner conveyed to a downstream end in the direction of the arrow D1 by the first agitation screw 23 is transferred to the second conveyance path 222 by way of the second communication path 224.

A small blade portion 26 in which an outer diameter of the first spiral blade 23*b* is partly reduced only in a specific section in the lateral direction is formed on a side of the first agitation screw 23 downstream of the toner supply port 25 in the toner conveying direction. In this small blade portion 26, a toner conveying capacity is reduced by as much as the blade diameter is reduced as compared with other parts of the first small blade portion 23*b*. Specifically, in an area where the small blade portion 26 is formed serves as a conveying capacity suppressing portion 27 for partly suppressing the toner conveying capacity. The conveying capacity suppressing portion 27 is provided to retain the toner near the toner supply port 25.

The second agitation screw 24 is arranged in the second conveyance path 222. The second agitation screw 24 includes a second rotary shaft 24*a* and a second spiral blade 24*b* spirally projecting on the outer periphery of the second rotary shaft 24*a*. The second agitation screw 24 supplies the toner to the developing roller 21 while conveying the toner in a direction of the arrow D2 by being driven to rotate about the second rotary shaft 24*a*. The toner conveyed to a downstream end in the direction of the arrow D2 by the second agitation screw 24 is transferred to the first conveyance path 221 by way of the first communication path 223.

The toner container 30 (FIG. 3) is arranged above the toner supply port 25 of the development housing 210. The toner container 30 includes a toner discharge port 319 (developer discharge port). The toner supply port 25 of the developing device 20 is open on the development housing 210 at a corresponding position below the toner discharge port 319. The toner stored in the toner container 30 is supplied into the development housing 210 from the toner discharge port 319 through the toner supply port 25.

Figure 5:
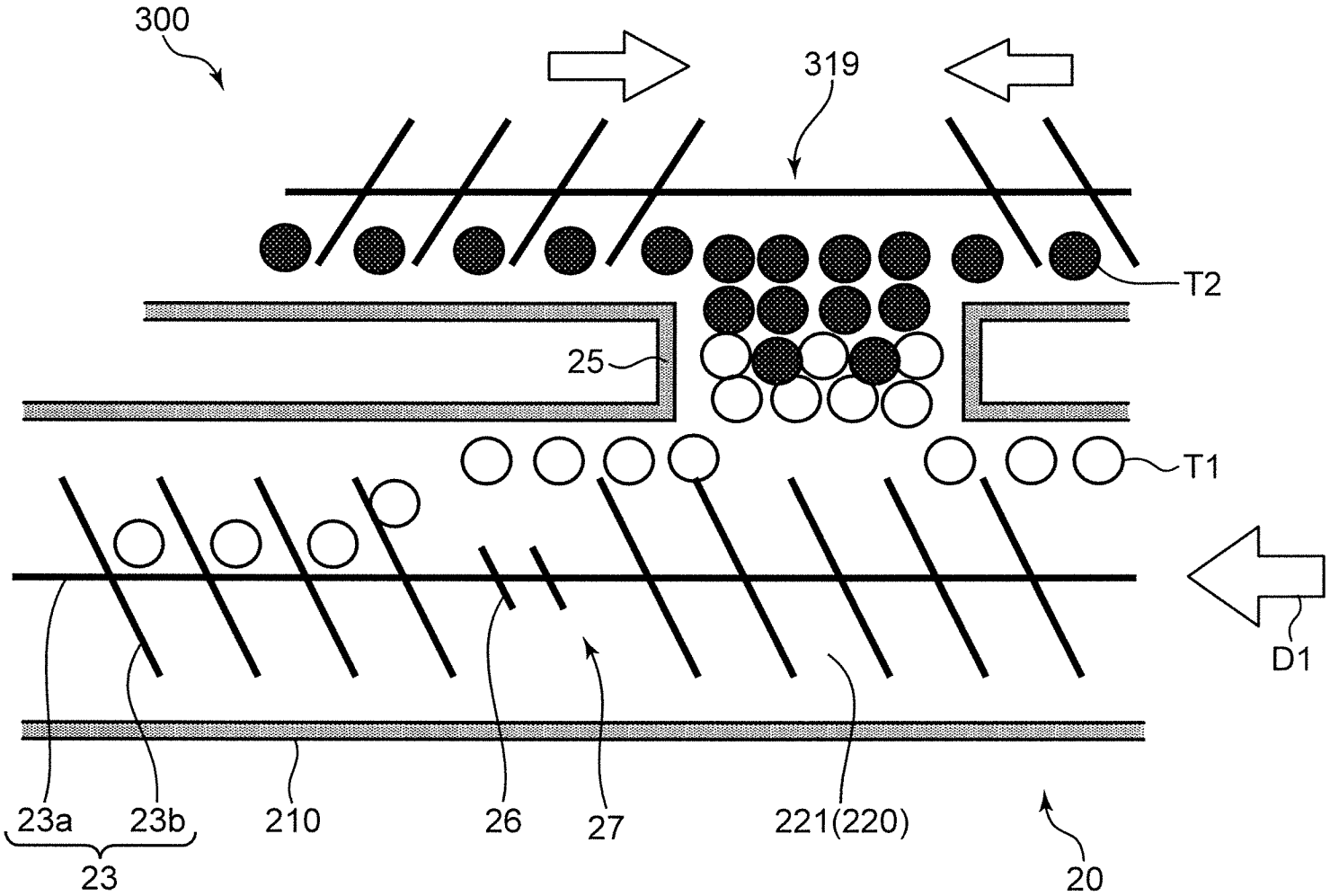
FIG. 5 is a diagrammatic sectional view showing a state where developer is supplied to the developing device.

In this embodiment, a volumetric supply method for automatically supplying the toner from the toner container 30 without depending on a toner sensor when the amount of the toner in the developing device 20 decreases is adopted as a method for supplying the toner to the developing device 20. The flow of the toner newly supplied through the toner supply port 25 in this volumetric supply method is described. FIG. 5 is a sectional view near a coupling portion of the toner supply port 25 of the developing device 20 and a toner discharge port 319 of a general toner container 300.

Replenishment toner particles T2 supplied from the toner discharge port 319 fall into the first conveyance path 221, are mixed with existing toner particles T1 and are conveyed in the direction of the arrow D1 by the first agitation screw 23. At this time, the toner particles T1 and T2 are agitated and charged. The first agitation screw 23 includes the small blade portion 26 downstream of the toner supply port 25 as described above. The small blade portion 26 is the conveying capacity suppressing portion 27 having a relatively low toner conveying capacity. If the first agitation screw 23 is driven to rotate in a state where the toner is sufficiently present in the storage space 220, the toner particles T1 start being retained in the conveying capacity suppressing portion 27. The toner particles T1 are retained from a position immediately upstream of the conveying capacity suppressing portion 27 to the position where the toner supply port 25 faces the first conveyance path 221. As a result, the entrance of the toner supply port 25 is closed by the retained toner particles T1.

Accordingly, the replenishment toner particles T2 cannot fall from the toner discharge port 319 in the state where the toner is sufficiently present in the storage space 220. Thus, the supply of the replenishment toner particles T2 is regulated. On the other hand, if the toner in the storage space 220 is consumed and the toner retained in the conveying capacity suppressing portion 27 decreases, the toner particles having closed the toner supply port 25 also decrease. As a result, the replenishment toner particles T2 can flow into the first conveyance path 221 (storage space 220) from the toner supply port 25 and the supply of the toner is realized.

Figure 6:
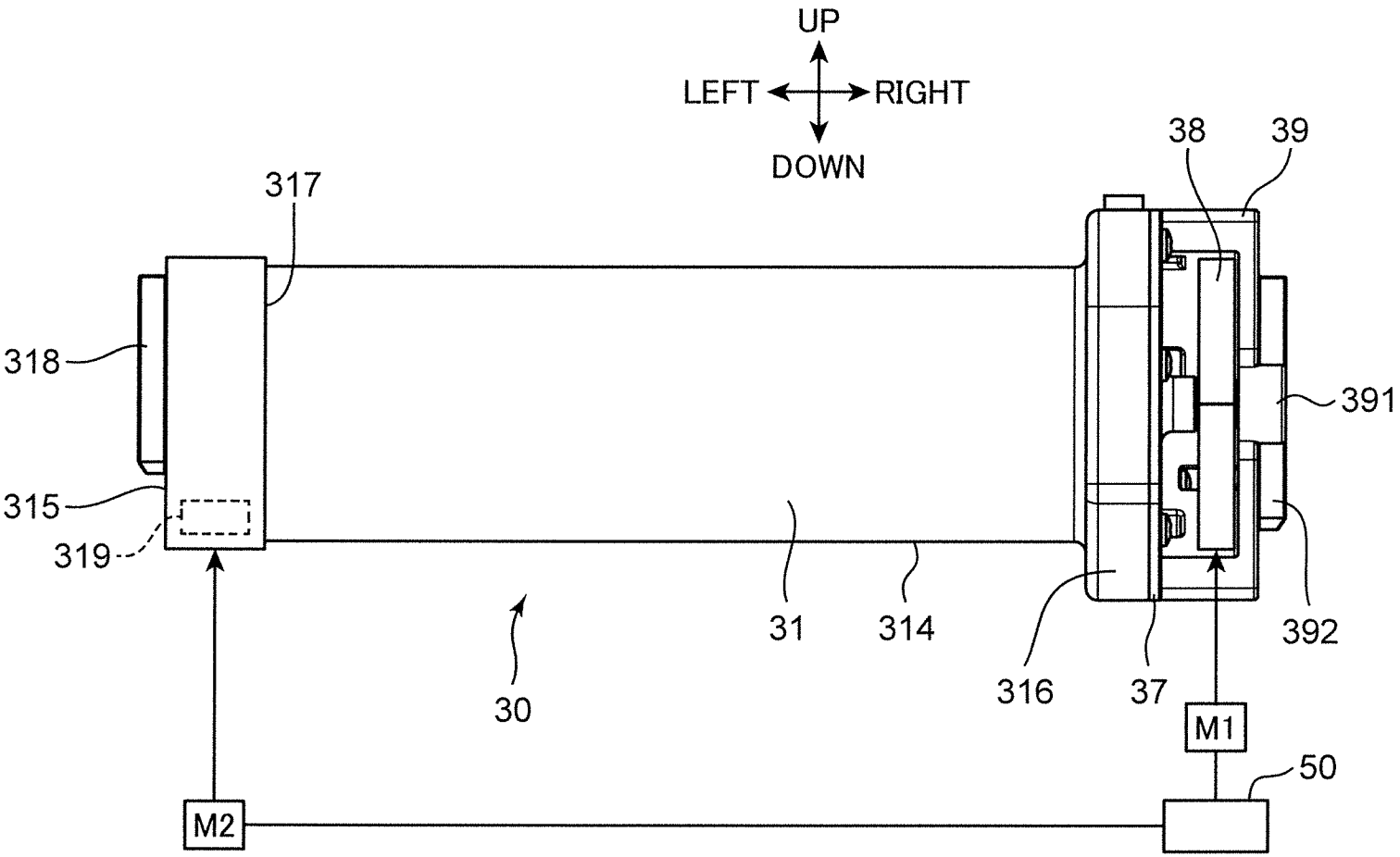
FIG. 6 is a side view showing a developer supply device according to one embodiment of the present disclosure.
Figure 7:
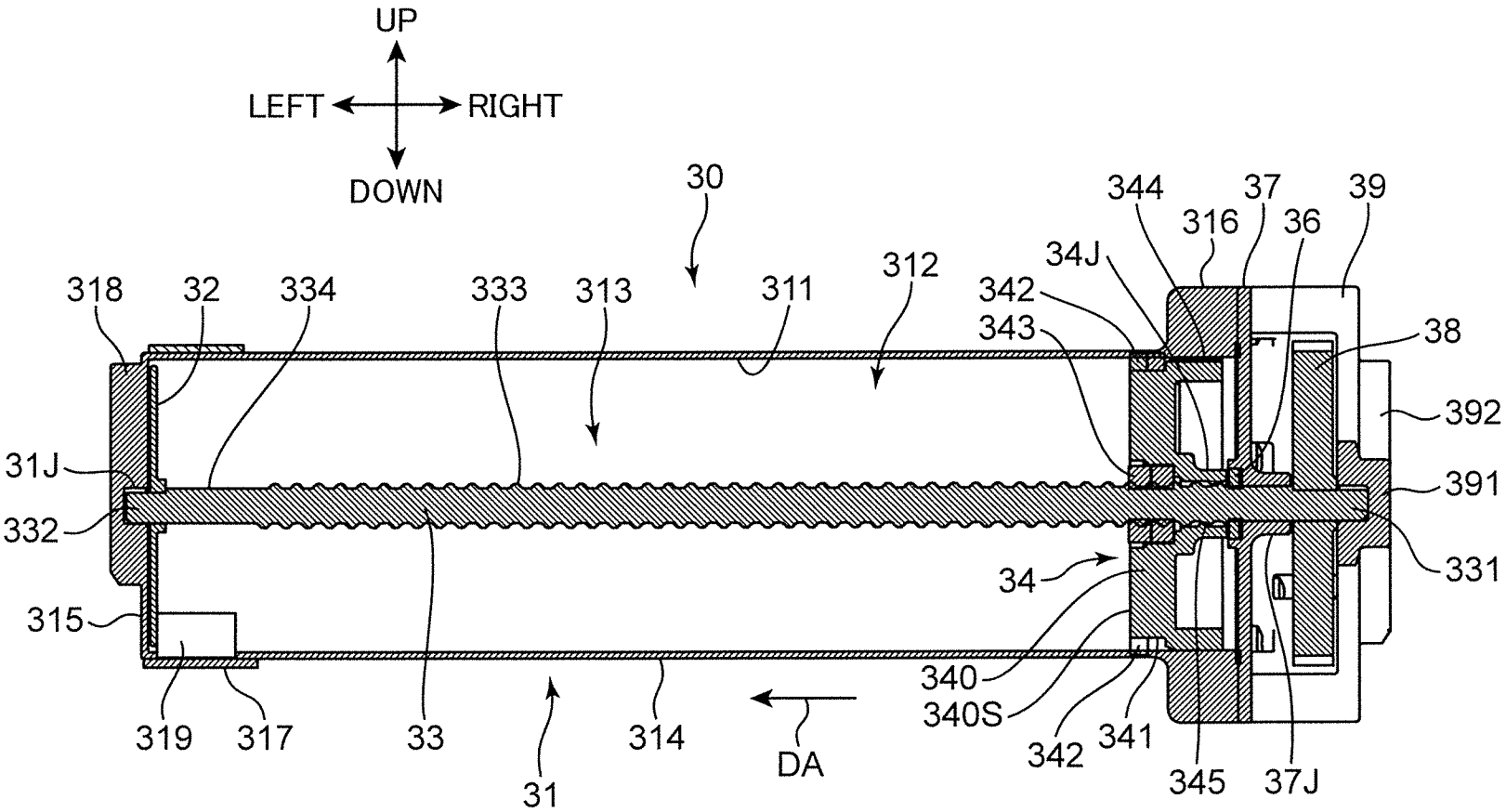
FIG. 7 is a lateral sectional view of the developer supply device of FIG. 6.

Next, a detailed structure of the toner container 30 of this embodiment is described. FIG. 6 is a side view showing the toner container 30 and peripheral devices (developer supply device) thereof and FIG. 7 is a lateral sectional view of the toner container 30. The toner container 30 includes a container main body 31 (container main body), an agitation disc 32, a shaft 33 (shaft portion), a moving wall 34, a sponge seal 36, a lid portion 37, a rotary gear 38 and a cover 39. Further, the peripheral devices include a first motor M1, a second motor M2 (driving unit) and a control unit 50.

The container main body 31 is a main body part of the toner container 30 having a cylindrical shape. The container main body 31 includes an inner peripheral portion 311 and an inner space 312. The inner peripheral portion 311 is a tubular inner peripheral surface of the container main body 31 extending in the lateral direction (first direction) which is a longitudinal direction of the toner container 30. The inner space 312 is a space capable of containing the toner. The inner space 312 is defined by a tubular trunk portion 314, a front wall 313 for sealing a left end side of the trunk portion 314 and a flange portion 316 and the lid portion 37 for sealing a right end side of the trunk portion 314. An area of the inner space 312 defined by the left wall 315 and the moving wall 34 and the inner peripheral portion 311 to be described later is a containing space 313. The containing space 313 is a space in the toner container 30 where the toner is actually contained.

The container main body 31 includes a shutter member 317 (shutter mechanism) and the toner discharge port 319 (developer discharge port). The shutter member 317 has a cylindrical shape and fitted on the outer periphery of the cylindrical container main body 31 near the left end rotatably about a cylinder center of the container main body 31. The toner discharge port 319 is an opening penetrating through the trunk portion 314 at a position below the left end side of the container main body 31 and allowing the inner space 312 to communicate with outside. The shutter member 317 is a member for switching a state between a closed state where the toner discharge port 319 is closed (sealed) from an outer peripheral side of the container main body 31 and an open state where the toner discharge port 319 is open to a predetermined opening degree if necessary. The toner contained in the containing space 313 is discharged toward the developing device 20 (toner supply port 25) from the toner discharge port 319 when the toner discharge port 319 is in the open state.

Figure 8:
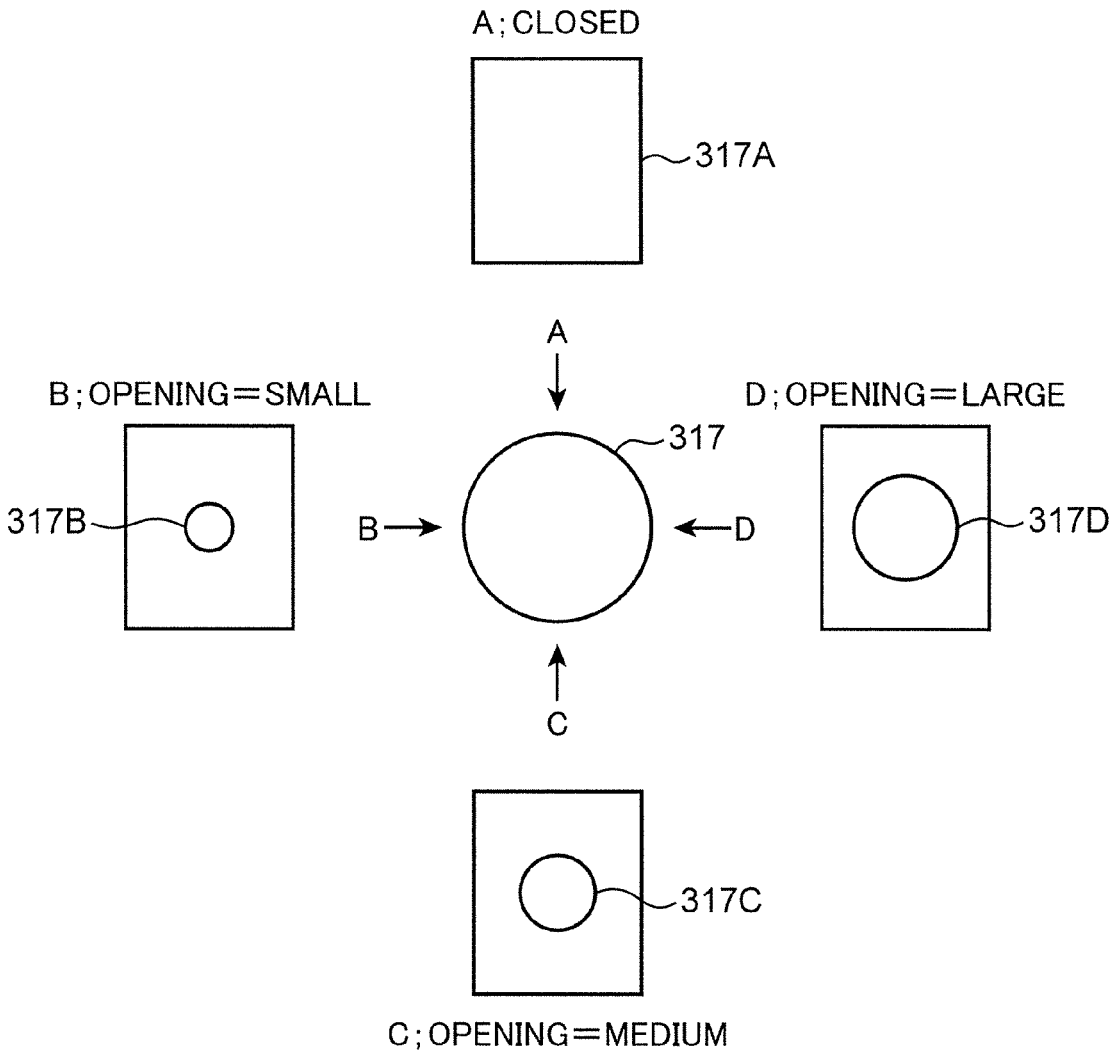
FIG. 8 is a diagram showing openings of a shutter member used in the developer supply device.

FIG. 8 is a diagram showing openings provided in the shutter member 317. In FIG. 8, the shutter member 317 is viewed in the lateral direction and a wall surface of the shutter member 317 at positions A, B, C, D at every 90° in a circumferential direction thereof is shown in a plan view at each position. The shutter member 317 includes, on a peripheral surface thereof, a closing portion 317A, a small opening 317B (first opening), a middle opening 317C and a large opening 317D (second opening) arranged along a rotating direction of the shutter member 317. The opening sizes of these openings are, for example, 30%, 70% and 100%, respectively when the opening size of the toner discharge port 319 is 100%. This is an example, and the opening size of the small opening 317B can be selected from a range of about 25% to 50% of the toner discharge port 319, that of the middle opening 317C can be selected in a range of about 50% to 80% and that of the large opening 317D can be selected in a range of about 80% to 100%.

The closing portion 317A is arranged at the position A. The closing portion 317A is a part of the wall surface of the shutter member 317 where no opening is present. When the shutter member 317 is rotationally moved so that the closing portion 317A faces the toner discharge port 319, the toner discharge port 319 is in the closed state. The small opening 317B formed by a circular opening is arranged at the position B. The small opening 317B is used when the toner discharge port 319 is open to a smallest opening degree (first open state). Specifically, a smallest supply amount of the toner is discharged from the toner discharge port 319 in a state where the small opening 317B is facing the toner discharge port 319.

The medium opening 317C formed by a circular opening is arranged at the position C. The medium opening 317C is used when the toner discharge port 319 is open to an opening degree larger than the small opening 317B and smaller than the large opening 317D. A larger supply amount of the toner than at the small opening 317B is discharged from the toner discharge port 319 in a state where the medium opening 317C is facing the toner discharge port 319. The large opening 317D formed by a circular opening is arranged at the position D. The large opening 317D is used when the toner discharge port 319 is open to a largest opening degree (second open state). A largest supply amount of the toner is discharged from the toner discharge port 319 in a state where the large opening 317D is facing the toner discharge port 319.

Note that although an example in which one medium opening 317C is provided between the smallest small opening 317B and the largest large opening 317D is illustrated in this embodiment, the shutter member 317 may include a plurality of medium openings having different opening degrees. In this way, the open state of the toner discharge port 319 can be more finely adjusted.

Referring back to FIGS. 6 and 7, a first guide portion 318 is a projecting portion vertically extending at the outer side of the left wall 315. The first guide portion 318 guides the mounting of the toner container 30 into the housing 101 together with a second guide portion 392 to be described later.

The agitation disc 32 is a disc-shaped plate member. The agitation disc 32 is fixed to a second shaft end portion 332 of the shaft 33 to be described later and integrally rotates with the shaft 33. The agitation disc 32 is arranged near the left wall 315 in the container main body 31 and agitates the toner present above the toner discharge port 319. Note that a projection projecting rightward toward the containing space 313 may be provided on the agitation disc 32 if the fluidity of the toner contained in the containing space 313 is low.

The shaft 33 is arranged to extend in the lateral direction (first direction) in the inner space 312 and rotatably supported by the container main body 31 and the lid portion 37 to be described later. The shaft 33 is driven to rotate about an axis thereof by the first motor M1. The shaft 33 includes a first shaft end portion 331, the second shaft end portion 332, an external spiral portion 333 and a moving wall stopping portion 334.

The first shaft end portion 331 is a right end of the shaft 33 and rotatably supported in a lid shaft hole portion 37J of the lid portion 37. The second shaft end portion 332 is a left end of the shaft 33 and rotatably supported in a bearing portion 31J provided on the left wall 315 of the container main body 31. The external spiral portion 333 is a spiral screw portion formed at a predetermined pitch on the outer peripheral surface of the shaft 33. The external spiral portion 333 of this embodiment is formed in an area of the shaft 33 from a position facing the flange portion 316 to a position immediately before the toner discharge port 319. The moving wall stopping portion 334 is an area arranged adjacent to a left end of the external spiral portion 333 and composed only of a shaft part where a convex part such as the external spiral portion 333 is not present. The moving wall stopping portion 334 is located above the toner discharge port 319.

The moving wall 34 is arranged in the inner space 312 and moves from right (upstream side in the first direction) to left (downstream side) along the shaft 33 in this inner space 312. The moving wall 34 is a wall for defining a right end surface of the containing space 313 where the toner is actually contained. The moving wall 34 moves from an initial position set in advance to a final position facing the toner discharge port 319 in the inner space 312 until the use of the toner container 30 is finished after being started. At this time, the moving wall 34 conveys the toner in the containing space 313 toward the toner discharge port 319. The moving wall 34 is engaged with the external spiral portion 333 of the shaft 33 and moves in a direction of an arrow DA by the shaft 33 being driven to rotate by the first motor M1.

The moving wall 34 includes a wall main body portion 340, a moving wall shaft hole portion 34J, an outer peripheral wall portion 341, an inner wall seal 342, a shaft seal 343 and an outer peripheral portion 344. The wall main body portion 340 is a part of a wall portion defining the containing space 313 and has a conveying surface 340S perpendicular to the shaft 33. The conveying surface 340S conveys the toner in the containing space 313 while pressing it as the moving wall 34 moves. A cylindrical hole holding the shaft seal 343 and penetrating through the shaft 33 is formed in a center of the wall main body portion 340. The moving wall shaft hole portion 34J is a tubular part projecting rightward from a center of the right surface of the wall main body portion 340. An internal spiral portion 345 engaged with the external spiral portion 333 of the shaft 33 is provided on the inner peripheral surface of the moving wall shaft hole portion 34J.

The outer peripheral wall portion 341 is a lateral peripheral wall of the wall main body portion 340 and facing the inner peripheral portion 311 of the container main body 31 with a predetermined gap defined therebetween. The inner wall seal 342 is a seal member arranged to cover around the outer peripheral wall portion 341 and compressively deformed between the inner peripheral portion 311 and the outer peripheral wall portion 341. When the moving wall 34 moves in the direction of the arrow DA, the toner in the containing space 313 is prevented from flowing to a side upstream of the moving wall 34 in the moving direction from a space defined by the inner peripheral portion 311 and the moving wall 34 by the inner wall seal 342.

The shaft seal 343 is arranged in contact with the external spiral portion 333 of the shaft 33 and cleans the toner adhering to the external spiral portion 333 as the moving wall 34 moves. The shaft seal 343 is arranged downstream of the moving wall shaft hole portion 34J in the moving direction of the moving wall 34. Accordingly, the shaft seal 343 comes into contact with the external spiral portion 333 earlier than the internal spiral portion 345 and the internal spiral portion 345 can travel on the external spiral portion 333 in a state where the toner is substantially removed from the external spiral portion 333. Further, the toner in the containing space 313 is prevented from flowing to the upstream side in the moving direction through a clearance between the shaft 33 and the moving wall 34 by a sealing function of the shaft seal 343.

The lid portion 37 is fixed to the flange portion 316 of the container main body 31 and seals an opening on the right surface of the container main body 31. The lid portion 37 includes the lid shaft hole portion 37J. The lid shaft hole portion 37J rotatably supports the shaft 33 on the side of the first shaft end portion 331. The sponge seal 36 is arranged between the moving wall shaft hole portion 34J and the lid portion 37. The sponge seal 36 prevents the leak-out of the toner from the lid shaft hole portion 37J of the lid portion 37 with the lid portion 37 fixed to the container main body 31.

The rotary gear 38 is fixed to the first shaft end portion 331 of the shaft 33 and integrally rotates with the shaft 33. The rotary gear 38 is coupled to the first motor M1 arranged in the housing 101 via an unillustrated transmission gear mechanism. When a rotational drive force is input from the first motor M1, the rotary gear 38 transmits the rotational drive force to the shaft 33 to move the moving wall 34.

The cover 39 is a cover member attached to the right end surface of the container main body 31. The cover 39 covers the right end surface of the container main body 31 while exposing a part of the rotary gear 38. The cover 39 includes a shaft cover portion 391 and the second guide portion 392. The shaft cover portion 391 covers an end part of the first shaft end portion 331 projecting from the rotary gear 38. The second guide portion 392 is a vertically extending projection. The toner container 30 is guided by this second guide portion 392 and the first guide portion 318 on the left end surface side of the container main body 31 when being mounted into the printer 100.

As described above, the first motor M1 is a drive source for moving the moving wall 34 via the shaft 33. The second motor M2 is a drive source for rotationally moving the shutter member 317 about the cylindrical center of the container main body 31. An unillustrated rotational force transmission mechanism is interposed between the second motor M2 and the shutter member 317.

The control unit 50 controls the drive of the first and second motors M1, M2. Specifically, the control unit 50 controls a moving position of the moving wall 34 on the shaft 33 by operating the first motor M1. Further, the control unit 50 controls a rotational movement of the shutter member 317 so that any one of the closing portion 317, the small opening 317B, the medium opening 317C and the large opening 317D selectively faces the toner discharge port 319 by operating the second motor M2.

Figure 9A:
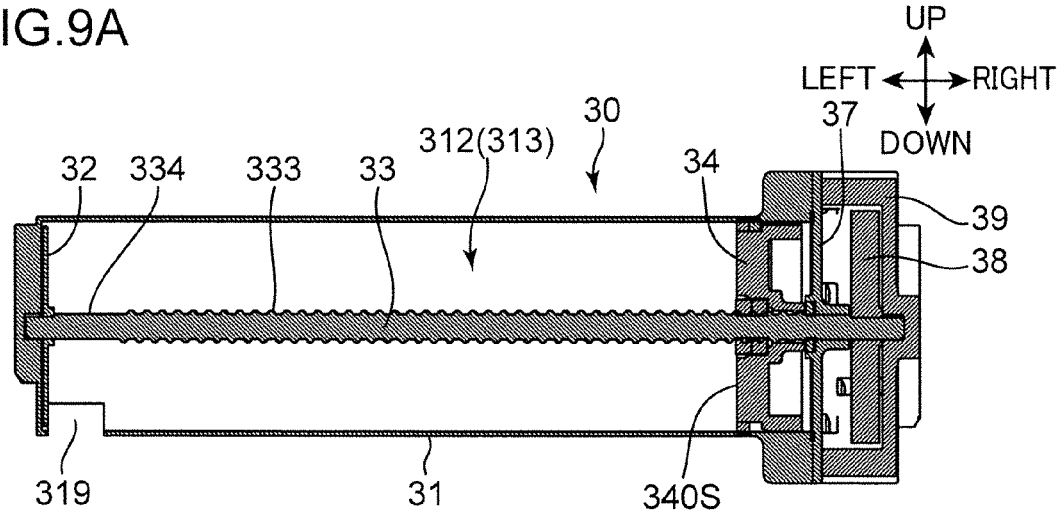
FIGS. 9A to 9C are sectional views showing a state where a moving wall moves in a container main body.
Figure 9B:
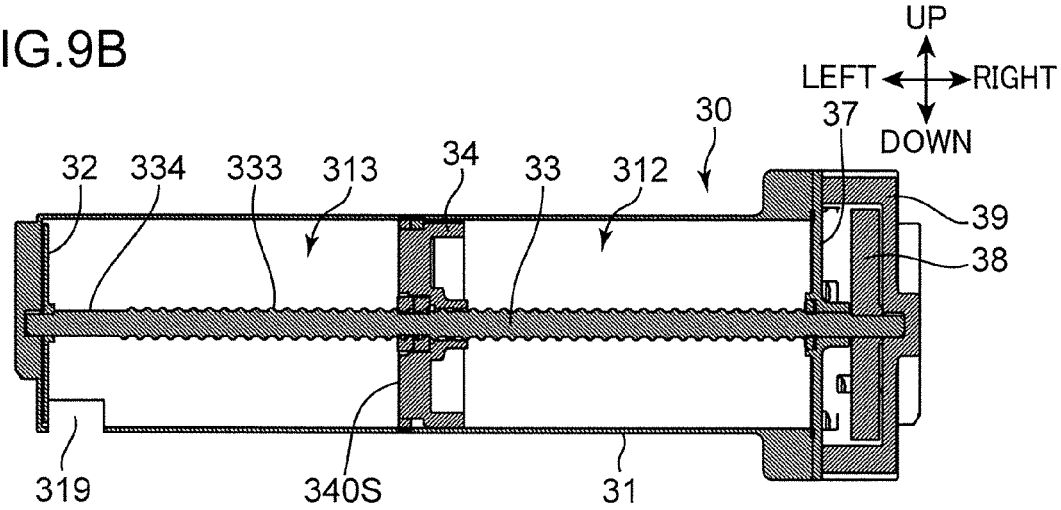
Figure 9C:
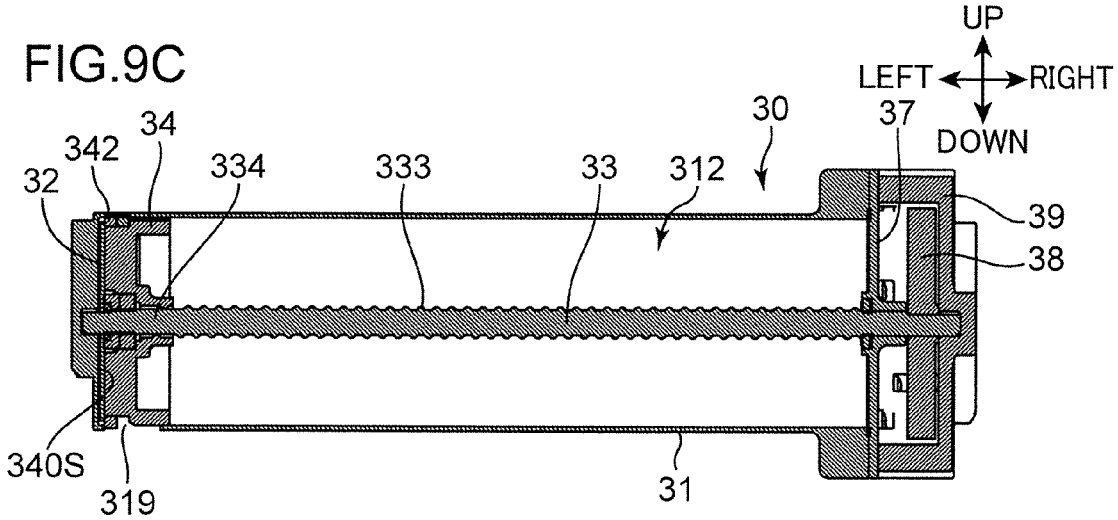

FIGS. 9A to 9C are sectional views showing a moving state of the moving wall 34 in the container main body 31. FIG. 9A shows a state where the moving wall 34 is at the initial position, FIG. 9B shows a state where the moving wall 34 is moved leftward from the initial position by about half the stroke and FIG. 9C shows a state where the moving wall 34 is at the final position facing the toner discharge port 319. In these figures, the shutter member 317 is not shown.

In the state of FIG. 9A, the containing space 313 for containing the toner is widest and takes up most of the inner space 312 of the container main body 31. Such a state is a state where the toner is fully contained and a state before the use of the toner container 30. At this time, the moving wall 34 is at a position adjacent to the lid portion 37.

In the state of FIG. 9B, about half the toner is consumed. The moving wall 34 moves leftward (first direction) from the initial position of FIG. 9A according to the consumption of the toner. A volume of the containing space 313 is reduced to about half the inner space 312. At this time, the conveying surface 340S of the wall main body portion 340 presses the toner in the containing space 313, thereby conveying the toner toward the toner discharge port 319. Note that a movement mode of the moving wall 34 is not particularly limited. For example, the moving wall 34 can be successively moved at a finer pitch as the toner decreases. Alternatively, the shaft 33 may be roughly divided into about three to six sections in the longitudinal direction and the moving wall 34 may be moved section by section as the toner decreases. In a later-described embodiment, an example is illustrated in which the shaft 33 is divided into four sections and the moving wall 34 is moved by the ¼ length of the shaft 33.

FIG. 9C shows a state where the toner is substantially used up (empty). The moving wall 34 has moved to the left end of the shaft 33 and is adjacent to the agitation disc 32. The containing space 13 is mostly lost. As a result, the amount of the toner remaining in the containing space 313 of the container main body 31 when the use is finished is reduced as compared with a toner container in which a volume of a containing space does not change. When the moving wall 34 reaches the final position facing the toner discharge port 319, the moving wall shaft hole portion 34J reaches the moving wall stopping portion 334. Thus, a leftward thrust force is no longer applied to the moving wall 34. Further, at this final position, an outer peripheral wall of the moving wall 34 closes the toner discharge port 319 from the inside of the container main body 31. Thus, the leakage of a small amount of the remaining toner can be suppressed by the moving wall 34 even without completely depending on the shutter member 317.

Figure 10:
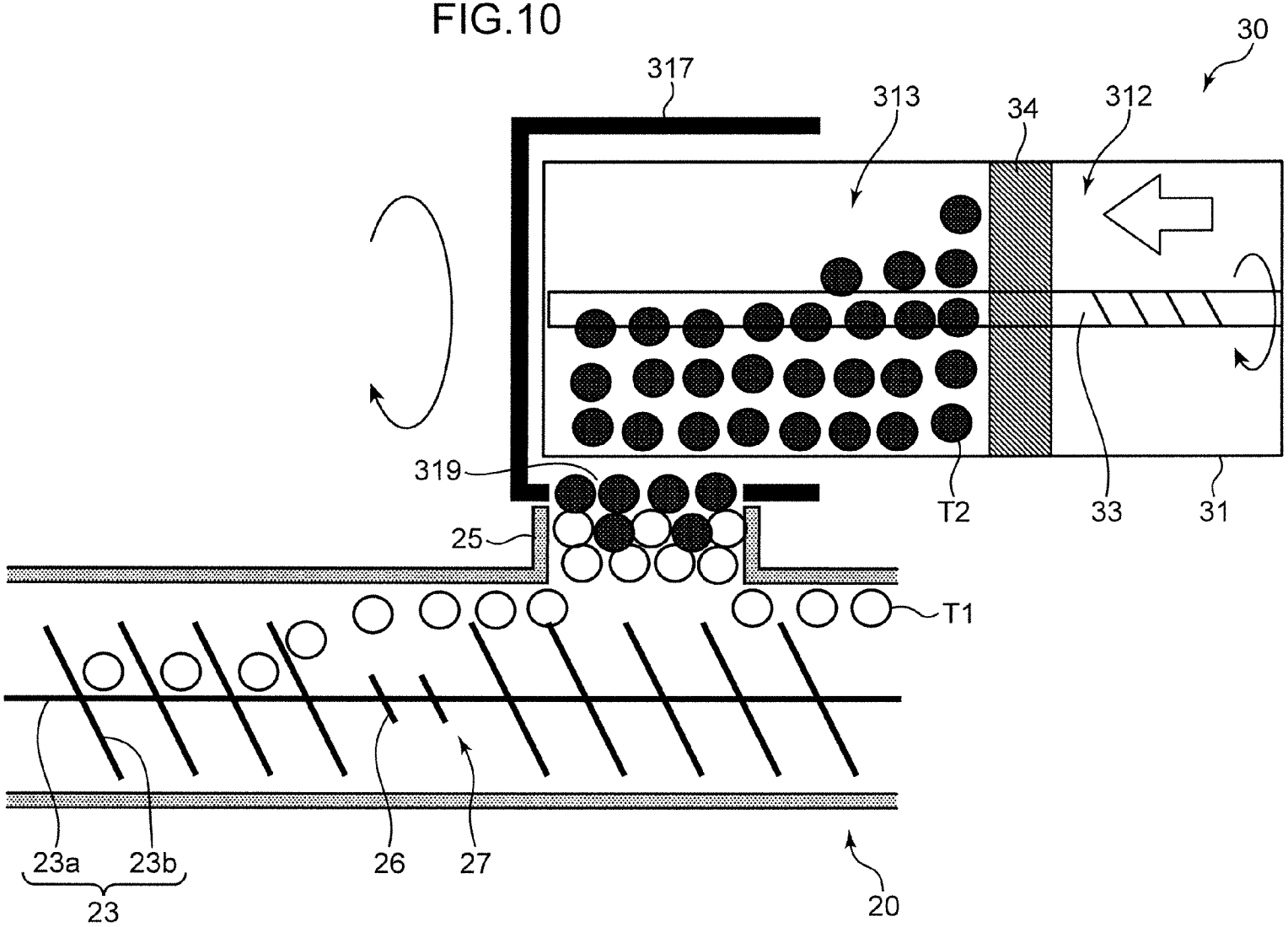
FIG. 10 is a diagrammatic sectional view showing a state where the developer is supplied to the developing device.

FIG. 10 is a diagrammatic sectional view showing a state where the toner is supplied from the toner container 30 to the developing device 20. As already described with reference to FIG. 5, the toner is supplied by the volumetric supply method in this embodiment. In the state where the toner is sufficiently present in the developing device 20, existing toner particles T1 are retained around the toner supply port 25 by the conveying capacity suppressing portion 27. When the toner of the developing device 20 is consumed, the toner particles T1 having closed the toner supply port 25 decrease and replenishment toner particles T2 in the toner container 30 enter the toner supply port 25. In this way, the toner supply port 25 is constantly closed. To maintain this state, the moving wall 34 presses and moves the replenishment toner particles T2 leftward to cover the toner discharge port 319.

Here, a problem recognized by the present disclosurer is a discharge pressure of the replenishment toner particles T2 from the toner discharge port 319. In an initial state where a storage amount of the replenishment toner particles T2 in the toner container 30 is full or close to full, the moving wall 34 is at a position distant from the toner discharge port 319 as shown in FIG. 9A and conveys a large amount of the replenishment toner particles T2 leftward. Further, air in the containing space 313 having a relatively large capacity is compressed by a leftward movement of the moving wall 34. The air can escape substantially only to the toner discharge port 319 and, accordingly, the replenishment toner particles T2 are discharged with force together with the air from the toner discharge port 319 in the initial state. That is, the discharge pressure is high.

On the other hand, as the storage amount of the replenishment toner particles T2 decreases, the moving wall 34 becomes closer to the toner discharge port 319 as shown in FIGS. 9B and 9C and the amount of the toner pressed and conveyed also decreases. Thus, a pressing force applied to the replenishment toner particles T2 located near the toner discharge port 319 is reduced and the replenishment toner particles T2 are discharged from the toner discharge port 319 clearly with less force as compared with the initial state. That is, the discharge pressure becomes lower.

Such a fluctuation of the discharge pressure of the replenishment toner particles T2 adversely affects the toner supply by the volumetric supply method. It is specifically because the toner supply is realized in dependence on a delicate pressure balance between the retained toner particles T1 closing the toner supply port 25 and the replenishment toner particles T2 trying to be mixed with the retained toner particles T1. If the discharge pressure is excessively high, the replenishment toner particles T2 more than a specified amount flow into the toner supply port 25 and the developing device 20 enters a state where the toner is excessively present. On the other hand, if the discharge pressure is excessively low, the specified amount of the replenishment toner particles T2 do not flow into the toner supply port 25 and the developing device 20 enters a state where the toner is in shortage. Both former and latter cases are factors hindering high-quality image formation.

Accordingly, in the present embodiment, the control unit 50 executes a control to switch the open state of the toner discharge port 319 according to the moving position of the moving wall 34. For example, the control unit 50 causes the moving wall 34 to be arranged at a right end position (first position) of the shaft 33 when a toner remaining amount in the container main body 31 is full (first remaining amount) and causes the moving wall 34 to move to an intermediate position (second position) closer to the toner discharge port 319 than the right end position by about half the length of the shaft 33 when the toner remaining amount is reduced to about half from the full amount (second remaining amount). In this case, the control unit 50 causes the small opening 317B of the shutter member 317 to face the toner discharge port 319 (first open state) when the moving wall 34 is at the right end position. Further, the control unit 50 causes the medium opening 317C or the large opening 317D of the shutter member 317 to face the toner discharge port 319 (second open state) when the moving wall 34 is at the intermediate position.

By executing such a control, the open state of the toner discharge port 319 is set to be larger than in the initial state when the moving wall 34 is located closer to the toner discharge port 319 than in the initial state. That is, when the toner remaining amount is large (first remaining amount) and the moving wall 34 is located near the upstream side in the moving direction, a toner discharge amount is regulated to a larger extent by reducing the open state of the toner discharge port 319. Conversely, when the toner remaining amount is small (second remaining amount) and the moving wall 34 is located near the downstream side, the toner discharge amount is relatively increased by increasing the open state of the toner discharge port 319. Thus, in the volume supply type toner container 30 using the moving wall 34, the opening degree of the toner discharge port 319 is adjusted according to the discharge characteristic of the toner, wherefore the amount of the toner supplied to the developing device 20 can be stabilized from the start to the end of the use of the toner container 30.

Figure 11:
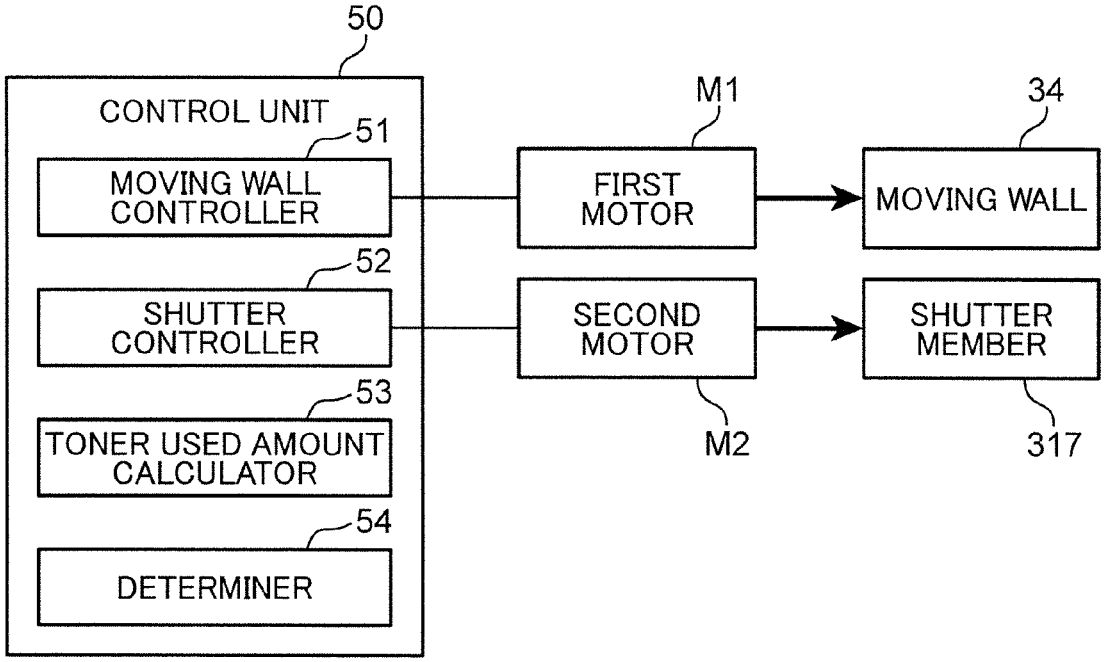
FIG. 11 is a block diagram showing a control configuration of the developer supply device.

A more specific example of the control unit 50 as described above is illustrated. FIG. 11 is a functional block diagram of the control unit 50 according to one embodiment. The control unit 50 is composed of a microcomputer and the like and functionally provided with a moving wall controller 51, a shutter controller 52 (part of the shutter mechanism), a toner used amount calculator 53 and a determiner 54 by executing a predetermined program.

The moving wall controller 51 controls the moving position of the moving wall 34 through a rotation amount of the shaft 33 by operating the first motor M1. The shutter controller 52 controls a rotational position of the shutter member 317 shown in FIG. 8 by operating the second motor M2. Specifically, the shutter controller 52 selects any one of the positions A, B, C and D of the shutter member 317 according to the moving position of the moving wall 34 and rotates the shutter member 317 so that the selected position faces the toner discharge port 319.

The toner used amount calculator 53 calculates a used amount of the toner in the toner container 30. Generally, an image forming apparatus such as a printer includes a dot counter for counting the number of dots derived based on a printing rate of image data given for a printing process. The toner used amount calculator 53 calculates a toner consumption amount of the toner container 30 based on a cumulative value of the dot counter. The determiner 54 determines whether or not to move the moving wall 34 and the shutter member 317 based on the toner consumption amount calculated by the toner used amount calculator 53.

Figure 12:
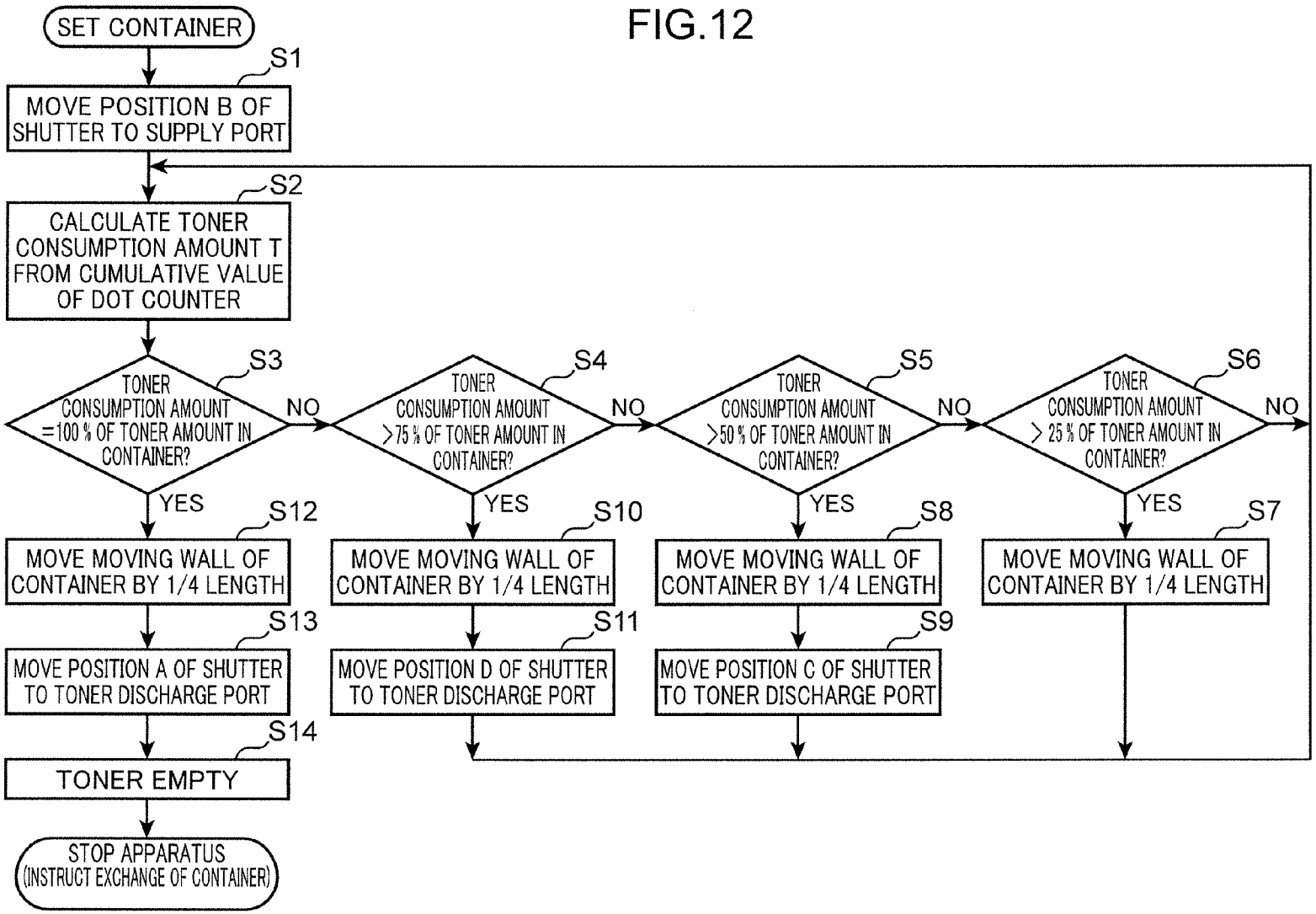
FIG. 12 is a flow chart showing the operation of the developer supply device.

FIG. 12 is a flow chart showing a process of the control unit 50. FIGS. 13A to 13F are diagrammatic sectional views respectively showing a relationship between the moving state of the moving wall 34 and the open state of the toner discharge port 319 by the shutter member 317. Here is shown an example in which the moving wall 34 is moved by the ¼ length of the shaft 33 in the longitudinal direction.

Figure 13A:
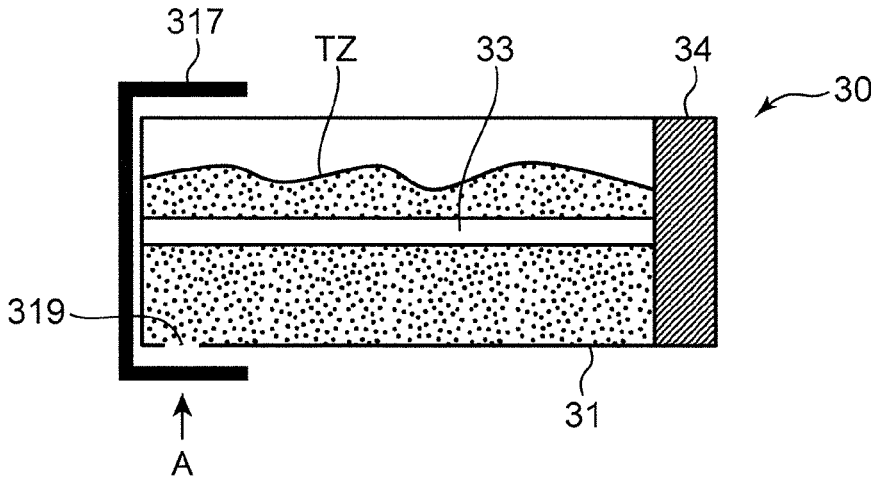
FIGS. 13A to 13F are sectional views showing a relationship of a moving state of the moving wall and an open state of a shutter.

The control unit 50 starts the process when the toner container 30 fully containing the toner is set in the inner space 107 (FIG. 2) of the housing 101. At this time, the shutter member 317 of the toner container 30 is at the position of the closed state, i.e. the closing portion 317A (FIG. 8) at the position A is facing the toner discharge port 319. This state is shown in FIG. 13A. The moving wall 34 is located on the right end of the shaft 33. Denoted by TZ is replenishment toner contained in the container main body 31.

Figure 13B:
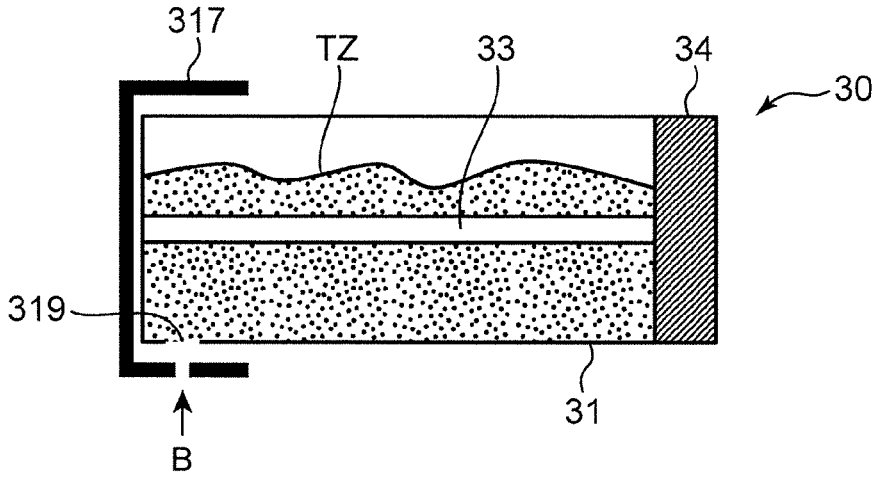

When the use of the toner container 30 is started, the shutter controller 52 operates the second motor M2 to rotate the shutter member 317, whereby the small opening 317B at the position B is caused to face the toner discharge port 319 (Step S1; first open state). This state is shown in FIG. 13B. Thereafter, the replenishment toner TZ can be supplied to the developing device 20 by the volumetric supply method. However, since the small opening 317B is facing the toner discharge port 319, a discharge pressure of the replenishment toner TZ is largely regulated. Thus, a large amount of the replenishment toner TZ is not ejected with force from the toner discharge port 319.

Subsequently, a toner consumption amount T of the toner container 30 is calculated based on a cumulative value of the dot counter of the toner used amount calculator 53 (Step S2). Subsequently, the determiner 54 determines whether or not to move the moving wall 34 and the shutter member 317 based on the calculated toner consumption amount T (Steps S3 to S6). Here, there are four conditions determined by the determiner 54:

(1) Whether or not the toner consumption amount T is 100% (T=100%) of an initial storage amount of the replenishment toner TZ stored in the toner container 30 (Step S3), (2) Whether or not the toner consumption amount T is more than 75% of the initial storage amount of the replenishment toner TZ (T>75%) (Step S4), (3) Whether or not the toner consumption amount T is more than 50% of the initial storage amount of the replenishment toner TZ (T>50%) (Step S5), and (4) Whether or not the toner consumption amount T is more than 25% of the initial storage amount of the replenishment toner TZ (T>25%) (Step S6).

If the toner consumption amount T is not more than 25% of the initial storage amount of the replenishment toner TZ (NO in any of Steps S3, S4, S5 and S6), the determiner 54 determines that neither the moving wall 34 nor the shutter member 317 needs to be moved. Thereafter, the process returns to Step S2. In this case, the state shown in FIG. 13B, i.e. the state where the moving wall 34 is located on the right end of the shaft 33 and the position B (small opening 317B) of the shutter member 317 is facing the toner discharge port 319 is continued.

Figure 13C:
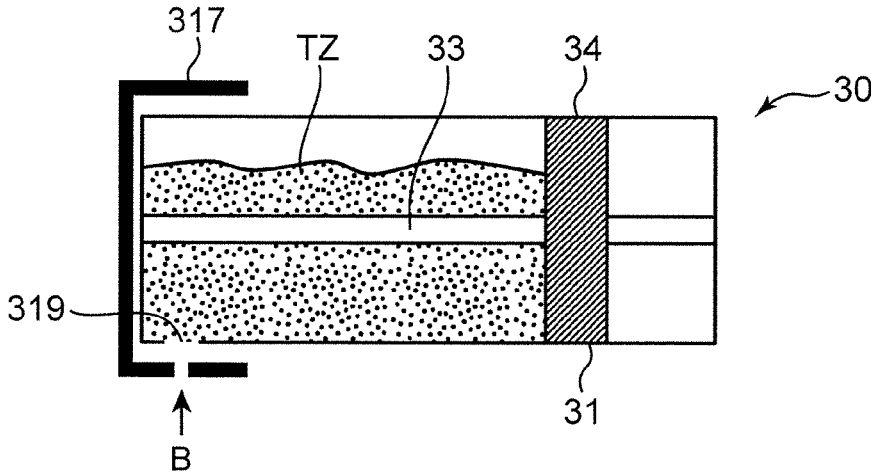

If the toner consumption amount T is more than 25% and not more than 50% of the initial storage amount of the replenishment toner TZ (NO in Steps S3, S4 and S5 and YES in Step S6), the determiner 54 determines that the moving wall 34 needs to be moved. In response to this determination, the moving wall controller 51 operates the first motor M1 to rotate the shaft 33 by a predetermined rotation amount and move the moving wall 34 leftward by the ¼ length of the shaft 33 (Step S7). On the other hand, the shutter member 317 needs not be moved. FIG. 13C shows a state where the operation of Step S7 is completed. Thereafter, the process returns to Step S2.

In this Step S7, a large amount of the replenishment toner TZ and air present in the container main body 31 are pushed leftward by the moving wall 34. Accordingly, a high pressure is applied to the toner discharge port 319. However, the opening of the toner discharge port 319 is regulated by the small opening 317B considerably smaller than the opening size of the toner discharge port 319 (e.g. the opening size of the toner discharge port 319 is regulated to 30%). Thus, the replenishment toner TZ is not excessively discharged. Note that since the moving wall 34 is moved by the ¼ length of the shaft 33 in this embodiment, the moving wall 34 is not moved until the condition of Step S5 is satisfied next once the condition of Step S6 is satisfied and the moving wall 34 is moved. For example, if the toner consumption amount T is calculated to be 26% in a certain routine and Step S7 is performed, Step S7 is skipped even if the toner consumption amount T is calculated to be 30% (YES determination in Step S6) in the next routine.

Figure 13D:
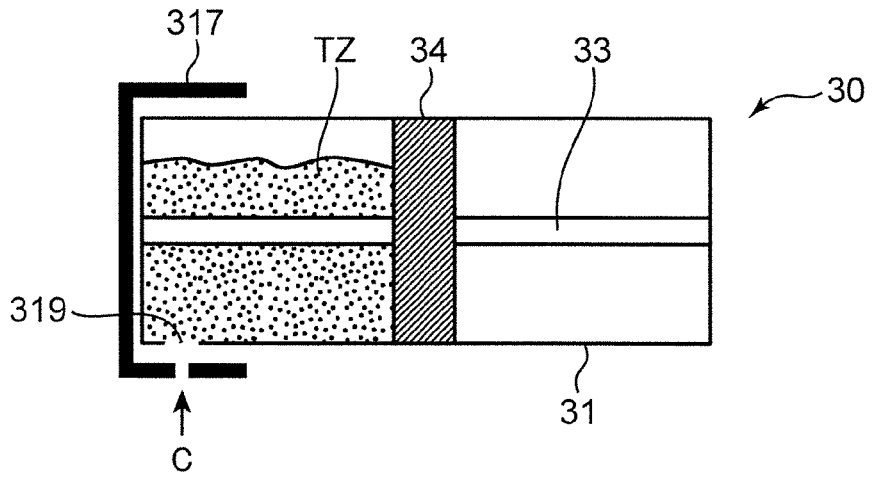

If the toner consumption amount T is more than 50% and not more than 75% of the initial storage amount of the replenishment toner TZ (NO in Steps S3 and S4 and YES in Step S5), the determiner 54 determines that both the moving wall 34 and the shutter member 317 need to be moved. The moving wall controller 51 operates the first motor M1 to move the moving wall 34 further leftward by the ¼ length of the shaft 33 (Step S8). Further, the shutter controller 52 operates the second motor M2 to rotate the shutter member 317 and cause the medium opening 317C at the position C to face the toner discharge port 319 (Step S9). FIG. 13D shows a state where the operation of Step S9 is completed. Thereafter, the process returns to Step S2. As in the above description, the moving wall 34 is not moved until the condition of Step S4 is satisfied next once the condition of Step S5 is satisfied and the moving wall 34 is moved (Steps S8, S9 are skipped).

In a situation where the determination result of Step S5 is YES, the replenishment toner TZ has been consumed by half the initial storage amount or more. When this stage is reached, the pressure applied to the toner discharge port 319 is considerably lower than in the initial state. If the opening regulation of the toner discharge port 319 by the small opening 317B is continued in this state, the supply amount of the replenishment toner TZ becomes insufficient. Thus, by regulating the opening of the toner discharge port 319 by the medium opening 317C (e.g. regulating the opening size of the toner discharge port 319 to 70%), a proper discharge amount of the replenishment toner TZ is ensured.

Figure 13E:
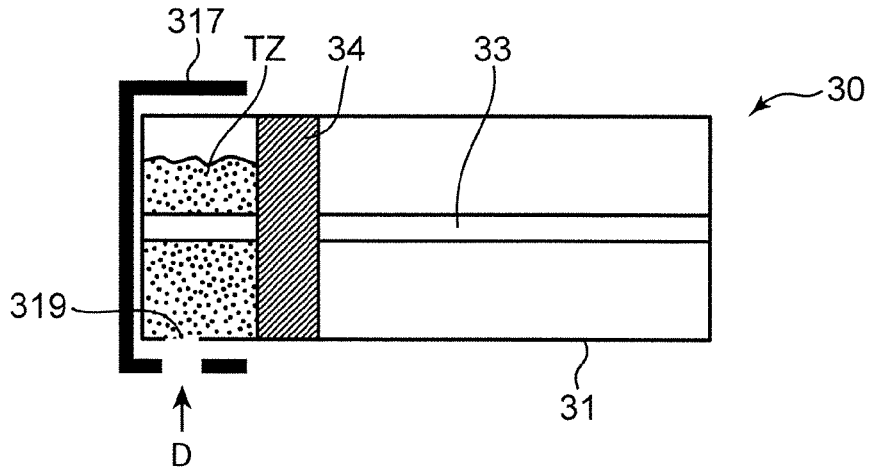

If the toner consumption amount T is more than 75% and below 100% of the initial storage amount of the replenishment toner TZ (NO in Step S3 and YES in Step S4), the determiner 54 determines that both the moving wall 34 and the shutter member 317 need to be moved. The moving wall controller 51 operates the first motor M1 to move the moving wall 34 further leftward by the ¼ length of the shaft 33 (Step S10). Further, the shutter controller 52 operates the second motor M2 to rotate the shutter member 317 and cause the large opening 317D at the position D to face the toner discharge port 319 (Step S11; second open state). FIG. 13E shows a state where the operation of Step S11 is completed. Thereafter, the process returns to Step S2. Once the condition of Step S4 is satisfied and the moving wall 34 is moved, the moving wall 34 is not moved until the condition of Step S3 is satisfied next (Steps S10, S11 are skipped).

In a situation where the determination result of Step S4 is YES, the replenishment toner TZ has been consumed by ¾ of the initial storage amount or more. In this state, the pressure applied to the replenishment toner TZ present near the toner discharge port 319 is largely reduced as compared with the initial state. Thus, the opening regulation of the toner discharge port 319 is no longer necessary. Accordingly, by causing the large opening 317D (having the same opening size as the toner discharge port 319) to face the toner discharge port 319, a proper discharge amount of the replenishment toner TZ is ensured.

Figure 13F:
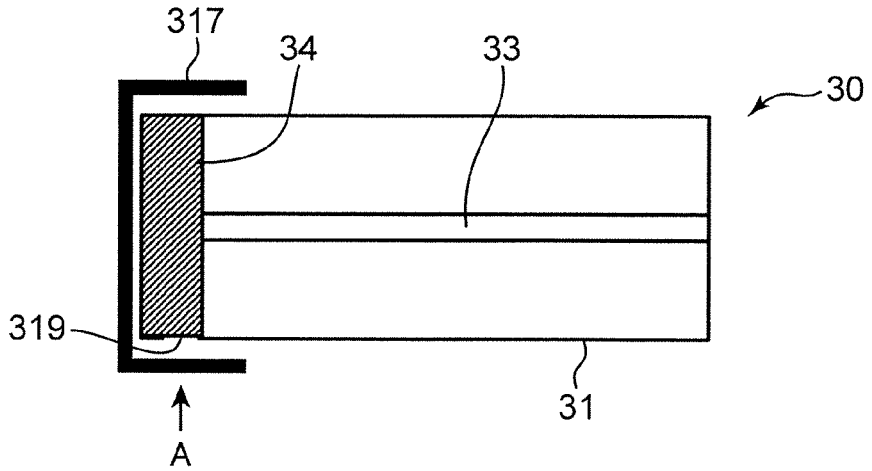

When the toner consumption amount T reaches 100% of the initial storage amount (YES in Step S3), the determiner 54 determines that both the moving wall 34 and the shutter member 317 need to be moved. The moving wall controller 51 operates the first motor M1 to move the moving wall 34 further leftward by the ¼ length of the shaft 33 (Step S12). The moving wall 34 reaches the left end of the shaft 33. Further, the shutter controller 52 operates the second motor M2 to rotate the shutter member 317 and cause the closing portion 317A at the position A to face the toner discharge port 319 (Step S13). FIG. 13F shows a state where the operation of Step S13 is completed. Thereafter, the determiner 54 gives a toner empty determination (Step S14), stops the operation of the printer 100 and causes an unillustrated display unit to display a message or a sign lamp urging an exchange of the toner container 30.

According to such a control, the amount of the replenishment toner TZ supplied to the developing device 20 can be stabilized since the opening degree of the toner discharge port 319 can be adjusted according to the consumed state of the replenishment toner TZ, i.e. the moving position of the moving wall 34. Further, since the moving wall 34 moves up to the left end of the shaft 33, the replenishment toner TZ in the container main body 31 can be thoroughly discharged. Furthermore, the toner discharge port 319 is closed by the shutter member 317 after a toner empty state is reached. This can prevent the leakage of the toner from the toner discharge port 319 when the toner container 30 is exchanged.

Although the toner container 30 and the printer 100 provided with the same according to the present disclosure have been described above, the present disclosure is not limited to this. The present disclosure can adopt, for example, the following modifications.

Figure 14:
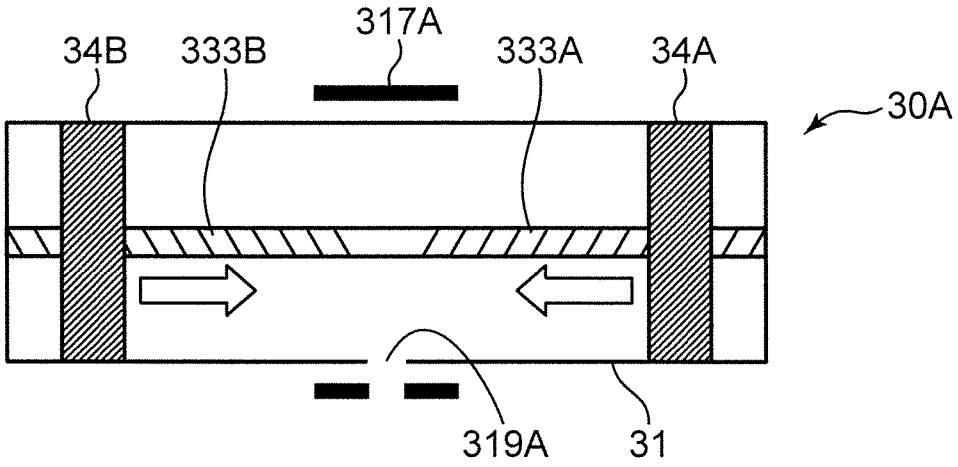
FIG. 14 is a sectional view showing a developer supply device according to a modified embodiment.

(1) In the above embodiment, an example is illustrated in which the toner discharge port 319 is arranged on the left end side of the container main body 31. Instead of this, a toner discharge port 319A may be arranged substantially in a longitudinal central part of the container main body 31 as shown in FIG. 14. In this case, two moving walls 34A, 34B are applied which respectively move toward the toner discharge port 319A from the right and left end sides of the container main body 31. A shaft includes two external spiral portions 333A, 333B having different spiral directions on left and right sides. The toner discharge port 319A is opened and closed and has an opening thereof adjusted by a shutter member 317A arranged in the central part of the container main body 31. Even if such a device configuration is adopted, functions and effects similar to those of the above embodiment can be enjoyed.

(2) In the above embodiment, an example is illustrated in which any one of the small opening 317B, the medium opening 317C and the large opening 317D of the shutter member 31 is circular as shown in FIG. 8. The shapes of these openings are arbitrary and can have triangular, rectangular, polygonal or other opening shapes or opening shapes divided into a plurality of sections.

(3) In the above embodiment, an example is illustrated in which the cylindrical shutter member 317 rotates about the cylindrical center of the container main body 31. This is an example. For example, a movable shutter piece may be arranged slidably relative to the toner discharge port 319. In this mode, the movable shutter piece is moved to shift a state, for example, among a state where the toner discharge port 319 is covered only by ⅓, a state where it is covered by ⅔ and a state where it is completely covered.

(4) In the case of using the toner container 30 illustrated in the above embodiment in setting up the printer 100, the opening of the toner discharge port 319 is desirably controlled by a technique different from the one described above. When the printer 100 is set up, the toner is not present at all in the developing device 20. In this case, after the toner container 30 is mounted into the inner space 107 of the housing 101, the large opening 317D at the position D of the shutter member 317 is caused to face the toner discharge port 319 instead of the control of Step S1 of FIG. 12. In addition, the moving wall 34 is moved at a faster moving speed than normal. In this way, a necessary amount of the toner can be supplied into the developing device 20 in a short time.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A developer supply device, comprising;

a container main body with a wall defining an inner space for containing developer;

a shaft portion arranged to extend in a first direction in the inner space;

a moving wall configured to convey the developer by moving from an upstream side to a downstream side in the first direction along the shaft portion in the inner space;

a developer discharge port arranged near a downstream end of the container main body in the first direction and penetrating through the wall to allow communication between the inner space and outside;

a shutter mechanism configured to switch an open state of the developer discharge port among a closed state, a first open state where the developer discharge port is open to a predetermined opening degree and a second open state where the developer discharge port is open to a larger opening degree than in the first open state; and a control unit configured to control a movement of the moving wall and a switch of the open state of the shutter mechanism, wherein the control unit:

causes the moving wall to be arranged at a first position in the first direction when a remaining amount of the developer in the container main body is a predetermined first remaining amount and moves the moving wall to a second position closer to the developer discharge port than the first position in the first direction when the remaining amount is a second remaining amount smaller than the first remaining amount; and causes the shutter mechanism to be set in the first open state when the moving wall is at the first position and causes the shutter mechanism to be set in the second open state when the moving wall is at the second position.

2. A developer supply device according to claim 1, wherein the control unit:

causes the moving wall to be arranged at the first position and sets the shutter mechanism in the closed state to the first open state when the use of the container main body fully containing the developer is started; and sets the shutter mechanism in the closed state after the developer in the container main body is substantially used up.

3. A developer supply device according to claim 1, where:

the shutter mechanism includes:

a shutter member which includes a closing portion corresponding to the closed state, a first opening corresponding to the first open state and a second opening corresponding to the second open state, and a driving unit configured to move the shutter member; wherein the control unit causes any one of the closing portion, the first opening and the second opening to face the developer discharge port by controlling the driving unit.

4. A developer supply device according to claim 3, wherein:

the container main body has a cylindrical shape;

the shutter member has a cylindrical shape to be rotatably fitted onto the outer periphery of the container main body; and the closing portion, the first opening and second opening are arranged along a rotating direction on a peripheral surface of the cylindrical shutter member.

5. A developer supply device according to claim 1, wherein:

the shutter mechanism is capable of adjusting the open state of the developer discharge port between the first open state and the second open state.

6. An image forming apparatus, comprising:

a developer supply device according to claim 1;

an image carrier configured to carry an electrostatic latent image and a developer image;

a developing device configured such that the developer is supplied thereto from the developer supply device and supplied to the image carrier therefrom; and a transfer unit configured to transfer the developer image from the image carrier to a sheet.

7. An image forming apparatus according to claim 6, wherein the developing device includes:

a housing with a developer conveyance path in which the developer is conveyed in a predetermined conveying direction;

a developer supply port open on the housing below the developer discharge port and configured to receive the developer from the developer supply device into the developer conveyance path;

a developer conveying member arranged in the developer conveyance path and configured to convey the developer in the conveying direction; and a conveying capacity suppressing portion configured to partly suppress a conveying capacity of the developer conveying member to convey the developer in the conveying direction at a downstream side of the developer supply port in the conveying direction.

* * * * *